US007273501B2

(12) United States Patent
Nakashima et al.

(10) Patent No.: US 7,273,501 B2
(45) Date of Patent: Sep. 25, 2007

(54) FIBER STRUCTURE HAVING HIGH WHITENESS AND HIGH MOISTURE-ABSORBING AND RELEASING PROPERTY, AND METHOD FOR PRODUCTION THEREOF

(75) Inventors: Shigeru Nakashima, Okayama (JP); Jo Mizobe, Suita (JP)

(73) Assignee: Japan Exlan Company, Limited, Osaka (JP)

( * ) Notice: Subject to any disclaimer, the term of this patent is extended or adjusted under 35 U.S.C. 154(b) by 0 days.

(21) Appl. No.: 10/483,226

(22) PCT Filed: Jul. 15, 2002

(86) PCT No.: PCT/JP02/07200

§ 371 (c)(1),
(2), (4) Date: Jan. 9, 2004

(87) PCT Pub. No.: WO03/010382

PCT Pub. Date: Feb. 6, 2003

(65) Prior Publication Data

US 2004/0185735 A1 Sep. 23, 2004

(30) Foreign Application Priority Data

Jul. 25, 2001 (JP) ..... 2001-224327
Oct. 31, 2001 (JP) ..... 2001-333893

(51) Int. Cl.
*C11D 3/00* (2006.01)
*D04H 13/00* (2006.01)

(52) U.S. Cl. ..... 8/115.51; 8/115.65; 264/182; 264/345; 442/332; 428/364; 428/394; 428/395

(58) Field of Classification Search ..... 428/364, 428/395, 394; 264/182, 345; 8/115.51, 8/115.65; 442/332
See application file for complete search history.

(56) References Cited

U.S. PATENT DOCUMENTS

| | | | | |
|---|---|---|---|---|
| 4,316,937 | A * | 2/1982 | Tanaka et al. | 428/376 |
| 5,366,510 | A | 11/1994 | Wasinger et al. | |
| 5,691,421 | A * | 11/1997 | Tanaka et al. | 525/329.2 |
| 5,853,879 | A * | 12/1998 | Takamiya et al. | 428/364 |
| 2002/0025749 | A1* | 2/2002 | Shimizu et al. | 442/118 |
| 2004/0185735 | A1* | 9/2004 | Nakashima et al. | 442/333 |

FOREIGN PATENT DOCUMENTS

| | | |
|---|---|---|
| EP | 0 777 000 A1 * | 6/1997 |
| JP | 51-119887 | 10/1976 |
| JP | 57-16968 | 1/1982 |
| JP | 57-29663 | 2/1982 |
| JP | 60-215865 | 10/1985 |
| JP | 4-174783 | 6/1992 |
| JP | 5-132858 | 5/1993 |
| JP | 05-171569 | 7/1993 |
| JP | 05-311539 | 11/1993 |
| JP | 9-158040 | 6/1997 |
| JP | 11-247069 | 9/1999 |
| JP | 2000-303353 | 10/2000 |
| JP | 2001-30402 | 2/2001 |

* cited by examiner

*Primary Examiner*—Jill Gray
(74) *Attorney, Agent, or Firm*—Wenderoth, Lind & Ponack, L.L.P.

(57) ABSTRACT

A highly white and highly moisture absorptive and desorptive fibrous structure where a moisture absorptive and desorptive synthetic fiber having a saturated index of moisture absorption of 10% by weight or more at 20° C. and 65% RH is blended, characterised in that, degree of whiteness of said fibrous structure in terms of indication method described in JIS Z 8729 is that L* is 90 or more, a* is within a range of ±2 and b* is within a range of ±10 and durability of whiteness degree against washing after washing for ten times is class 3-4 or higher.

10 Claims, No Drawings

FIBER STRUCTURE HAVING HIGH WHITENESS AND HIGH MOISTURE-ABSORBING AND RELEASING PROPERTY, AND METHOD FOR PRODUCTION THEREOF

TECHNICAL FIELD

The present invention relates to a highly white and a highly moisture absorptive and desorptive fibrous structure which has a moisture absorptive and desorptive property and still has an excellent degree of whiteness and an excellent stability in the degree of whiteness where the degree of whiteness hardly changes even upon repeated washings and also relates to a method for manufacturing the same. Making the best use of the above-mentioned functions, the fibrous structure is able to be advantageously used for the use including clothing such as underwear and sweater, curtain, bedding such as blanket, etc.

BACKGROUND OF THE INVENTION

Various fibrous structures having a high moisture absorptive and desorptive property have been proposed already. For example, in the Japanese patent laid-open No. 11/247069, there is proposed a cloth having fine particles of a highly moisture absorptive and desorptive organic substance on the cloth. However, in such a cloth, a means for fixing the highly moisture absorptive and desorptive organic fine particles on the surface of the fiber is necessary and, further, in the highly moisture absorptive and desorptive organic fine particles, a cross-linking structure is introduced into fine particles of acrylonitrile by hydrazine whereby it is colored in light pink color to light brown color and degree of whiteness of the cloth is poor. In the Japanese patent laid-open No. 2001/30,402, there is proposed a water absorptive and moisture absorptive cloth using a highly water absorptive and moisture absorptive fiber where the difference in moisture absorptive ratios between 20° C. at 60% RH and 20° C. at 97% RH is 30% or more and the water absorptive amount per unit fiber is 300% by weight to 8000% by weight. However, in such a cloth, a highly water absorptive and moisture absorptive fiber where the water absorptive amount per unit fiber is 300% by weight or more is used and, therefore, the area where water is absorbed has a sticky feeling and there is a problem that, in order to solve the above, it is to be made into a two-layered structure.

It has been also known that the hue is from light pink color to light brown color in a moisture absorptive and desorptive fiber of an acrylic acid type which is subjected to introduction of cross-link by a hydrazine compound into an acrylic fiber followed by hydrolysis and, if necessary, subjected to introduction of carboxyl group of a metal salt type by means of neutralization. Accordingly, the fibrous structure where such a moisture absorptive and desorptive fiber of an acrylic acid type is blended keeps the hue of the fiber as it is whereby it is not suitable for white things. In addition, a fibrous structure where a moisture absorptive and desorptive fiber of an acrylic acid type and cotton are blended is usually bleached with hydrogen peroxide, sodium chlorite or the like for removing cotton dust and fat/oil coming from the starting material for the cotton. However, there is a problem that, as a result of such a treatment, the hue of the moisture absorptive and desorptive fiber of an acrylic acid type becomes darker and, therefore, the use has been limited. Further, a fibrous structure where a moisture absorptive and desorptive fiber of an acrylic acid type and wool are blended is usually subjected to a bleaching treatment with a reducing agent for removing fat/oil, etc. coming from the starting material for wool and making white. However, there is a problem that, although color of the moisture absorptive and desorptive fiber of an acrylic acid type becomes light by such a treatment, the stability is poor and the color returns to pink or light brown by washing whereby that does not satisfy the requirement for white color especially in the field of clothing.

As a method for solving such problems, there have been known a method where the original hue of the moisture absorptive and desorptive fiber of an acrylic acid type is covered by means of dyeing and a method where the moisture absorptive and desorptive fiber of an acrylic acid type is subjected to a reversible knitting inside. However, those methods are for colored things anyway and are not suitable for the need of white things.

In addition, there have been disclosed some methods where original hue of the moisture absorptive and desorptive fiber of an acrylic acid type is improved. For example, since a moisture absorptive and desorptive fiber of an acrylic acid type prepared by a method of the Japanese patent laid-open No. 05/132,858 shows dark pink color to dark brown color, there is a disadvantage that its use is limited and, in the invention of the Japanese patent laid-open No. 09/158,040 proposed for overcoming the disadvantage, there is disclosed that an acid treatment A is conducted after a cross-linking treatment with a hydrazine compound and that an acid treatment B is conducted after a hydrolyzing treatment with an alkali whereby a considerable improvement in whiteness is achieved. However, even by such a technique, there is still a problem that the moisture absorptive and desorptive fiber of an acrylic acid type is colored in bleaching said fiber blended with cotton. In the Japanese patent laid-open No. 2000/303,353, there is disclosed that, as a method for improving the whiteness of a moisture absorptive and desorptive fiber of an acrylic acid type, a hydrolyzing treatment is carried out in an oxygen-free atmosphere. However, even in such a method, the resulting fiber is colored upon bleaching treatment and repeated washing and, therefore, it is the current status that a disadvantage of poor stability in whiteness still remains. Accordingly, even in a moisture absorptive and desorptive fiber of an acrylic acid type having an improved original hue, that is not still in a level of being durable to bleaching and to reducing treatment when made into a blended fabric.

OBJECTS OF THE INVENTION

The present invention has been achieved for solving the above-mentioned problems and its objects are to provide a highly white and highly moisture absorptive and desorptive fibrous structure having an excellent moisture absorptive and desorptive property, excellent degree of whiteness and stability of the degree of whiteness causing almost no change in the whiteness even upon repeated washing and showing no stickiness even when moisturized and also to provide a method for manufacturing the same.

SUMMARY OF THE INVENTION

The above-mentioned objects of the present invention can be advantageously achieved by a highly white and highly moisture absorptive and desorptive fibrous structure which is a fibrous structure where a moisture absorptive and desorptive synthetic fiber having a saturated index of moisture absorption of 10% by weight or more at 20° C. and 65%

RH is blended, characterized in that, degree of whiteness of the fibrous structure in terms of indication method described in JIS Z 8729 is that L* is 90 or more, a* is within a range of ±2 and b* is within a range of ±10 and durability of whiteness degree against washing after washing for ten times is class 3-4 or higher and also by a method for the manufacture of a highly white and highly moisture absorptive and desorptive fibrous structure which is characterized in that a fibrous structure where a moisture absorptive and desorptive synthetic fiber having a saturated index of moisture absorption of 10% by weight or more at 20° C. and 65% RH is blended is reduced with sodium hydrosulfite or with thiourea dioxide and then subjected to an acid treatment with sulfuric acid or nitric acid.

DETAILED DESCRIPTION OF THE INVENTION

The present invention will now be illustrated in detail as hereunder. There is no particular limitation for a moisture absorptive and desorptive synthetic fiber used in the present invention so far as it is a synthetic fiber where a saturated index of moisture absorption is 10% by weight or more at 20° C. and 65% RH.

The fibrous structure in which such a moisture absorptive and desorptive fiber is blended is a product where a moisture absorptive and desorptive fiber is blended with fiber which is other than the moisture absorptive and desorptive fiber such as acrylic fiber, modacrylic fiber, Nylon, polyester, Vinylon, rayon, polyurethane, cotton, silk, wool and linen. With regard to its shape, there are wadding, yarn, woven fabric, knitted fabric, nonwoven fabric and a combination thereof. Although there is no particular limitation for the fiber other than the moisture absorptive and desorptive fiber, ratio thereof, etc., it is necessary that degree of whiteness of the fibrous structure in terms of indication method described in JIS Z 8729 is that L* is 90 or more, a* is within a range of ±2 and b* is within a range of ±10 and durability of whiteness degree against washing after washing for ten times is class 3-4 or higher. Accordingly, it is preferred that the moisture absorptive and desorptive fiber and other fiber also have such degree of whiteness and durability of degree of whiteness against washing and a fibrous structure where a fibrous structure is once prepared and then subjected to treatments such as soaking or bleaching so that the whiteness degree characteristic is made within the above-mentioned range is included within the category of the present invention as well. Incidentally, with regard to the blending mode of the moisture absorptive and desorptive fiber, its examples are blending with other fiber in spinning, cross-twisting in fine spinning and twisting steps, common cross-knitting and weaving and two- to three-layer cross-knitting and weaving in the preparation of cloth, etc. although they are non-limitative.

The value (class) of durability against washing is measured as follows. Thus, a sample is subjected to a washing treatment by a method mentioned in JIS-L0217-103 ("Attack" manufactured by Kao was used as a detergent) and degree of color change of the sample after repeated washing treatments for ten times from the color of the sample before washing is evaluated by a grey scale for assessing staining according to JIS-L0805.

It is preferred that air permeability of the fibrous structure according to the present invention is 5 $cm^3/cm^2$/second or more and, more preferably, it is 10 $cm^3/cm^2$/second or more. When the air permeability is less than 5 $cm^3/cm^2$/second, flow of air is bad and there are some cases where a sufficient moisture absorptive and desorptive property is not achieved whereby that is no preferred. With regard to a means for preparing such a fibrous structure satisfying such an air permeability, publicly known means is applicable and the object can be achieved by an appropriate selection of fineness of single fiber, length of fiber, size of yarn, twisted numbers of yarn, weight per unit area, processing condition, etc.

It is preferred that the moisture absorptive and desorptive fiber adopted by the present invention has a saturated index of water absorption is less than 300% by weight. When the saturated index of water absorption is 300% by weight or more, the fibrous structure becomes sticky when much moisture or water is absorbed and, therefore, that is not preferred for use as clothing, particularly as underwear.

Further, with regard to the moisture absorptive and desorptive fiber adopted by the present invention, a moisture absorptive and desorptive fiber of an acrylic acid type where fiber of an acrylic type is subjected to introduction of cross-link by a hydrazine compound and hydrolysis followed, if necessary, by introduction of carboxyl group of a metal salt type by means of neutralization is preferred. Examples of such a moisture absorptive and desorptive fiber of an acrylic acid type which is now available in the market are "eks®", "MOIS CARE®", "Desmel®", "Etiquette®" and "MOIS FINE™" which are trade names manufactured by Toyobo.

It is necessary that degree of whiteness of the highly white and highly moisture absorptive and desorptive fibrous structure of the present invention is that L* is 90 or more, a* is within a range of ±2 and b* is within a range of ±10 in terms of an indication method described in JIS-Z-8729. When a moisture absorptive and desorptive fiber of an acrylic acid type colored in light pink to light brown is used as a moisture absorptive and desorptive fiber, an example of specific means for satisfying such a degree of whiteness is a means where a fibrous structure where a moisture absorptive and desorptive fiber of an acrylic acid type is blended therewith is subjected to a reducing treatment using sodium hydrosulfite or thiourea dioxide and then subjected to an acid treatment with sulfuric acid or nitric acid.

When such a means is adopted, the fibrous structure where a moisture absorptive and desorptive fiber of an acrylic acid type is blended is whitened by means of reduction using sodium hydrosulfite or thiourea dioxide and, as a result of the next acid treatment with sulfuric acid or nitric acid, the whitening becomes a stable one showing little color change against washing. With regard to the concentration of an aqueous solution of sodium hydrosulfite or thiourea dioxide used for the reducing treatment, a range of 0.1 to 50 g/liter or, preferably, a range of 0.3 to 10 g/liter is used. With regard to the concentration of an aqueous solution of sulfuric acid or nitric acid used for the acid treatment, a range of 0.3 to 10% by weight or, preferably, a range of 0.5 to 5% by weight is used. A ratio of the fibrous structure to the treating solution in the reducing treatment and acid treatment or, in other words, a bath ratio may be appropriately decided depending upon the apparatus used for the treatment and 1/2 to 1/100 or, preferably, 1/3 to 1/50 is used in an industrial case. With regard to temperature and time for such a treatment, temperature of 30 to 130° C. or, preferably, 40 to 120° C. and treating time of 10 to 120 minutes or, preferably, 20 to 60 minutes are adopted for both treatments.

When the fiber which is other than a moisture absorptive and desorptive fiber is cotton or wool, such means are more effective.

When cotton is blended as a fiber other than a moisture absorptive and desorptive fiber, a bleaching treatment is carried out with hydrogen peroxide or sodium chlorite for removing cotton dust and fat/oil contained in the raw cotton and for whitening the cotton and then the above reducing treatment and acid treatment are carried out. As to the bleaching treatment, a common bleaching condition for cotton may be adopted and its example is that, in the case of bleaching with hydrogen peroxide, a treatment is carried out at 60 to 100° C. for 30 to 60 minutes in an aqueous solution containing 10 to 15 ml/liter of 30% by weight of hydrogen peroxide, being adjusted to pH 10 to 12 with an alkaline agent and being added with an appropriate amount of surface-active agent as a scouring agent. An example in the case of bleaching with sodium chlorite is a treatment at 60 to 100° C. for 30 to 60 minutes in an aqueous solution where a scouring agent, a rust preventive, etc. are added to an aqueous solution of 1 to 5 g/liter of sodium chlorite. As a result of such a treatment, cotton is able to be whitened although the moisture absorptive and desorptive fiber of an acrylic acid type is oxidized whereupon some color changes to pink color or beige color take place. In order to recover the color change and further to improve the durability to washing, a reducing treatment and an acid treatment are carried out after bleaching.

When wool is blended as a fiber which is other than a moisture absorptive and desorptive fiber, a reducing treatment and then an acid treatment which are recommended by the present invention are carried out so that fat/oil, etc. attached to the raw wool are removed and whitened. Although the both component materials whiten by a reducing treatment, durability of whiteness of the moisture absorptive and desorptive fiber of an acrylic acid type to washing is poor in this stage. But that can be stabilized by the following acid treatment.

When an acid treatment is carried out after the reducing treatment as such, carboxyl group of a salt type in the moisture absorptive and desorptive fiber of an acrylic acid type is changed to carboxylic acid (carboxyl group) and this may lower the functions of the fibrous structure such as moisture absorptive and desorptive properties, heat generating properties by absorping moisture and pH buffering ability. Accordingly, it is also one of preferred modes for carrying out the invention that, after such an acid treatment for the fibrous structure, neutralization with alkaline metal hydroxide, alkaline metal carbonate or the like is carried out if necessary so that carboxyl group of a metal salt type is revived. It is also a preferred method that, for an object of making neutralizing reaction uniform during the course of neutralization as such, a buffer such as sodium acetate or sodium phosphate is used together or, for an object of suppressing the recovery of whitened one to original color, neutralization is carried out using a weakly alkaline compound such as an alkaline metal carbonate.

It is further possible that, after such reducing and acid treatments for the fibrous structure, a fluorescent whitening dyeing treatment using a fluorescent whitener is carried out. In that case, the reducing and acid treatments to the fibrous structure function as a pretreatment whereupon it is possible to further enhance the whiteness after the fluorescent whitening dyeing. It is preferred that such a fluorescent whitening dyeing treatment is carried out after the above-mentioned neutralizing treatment so as to avoid decomposition and sedimentation of the fluorescent dye and to make the control of pH of the dyeing bath upon dyeing easy. Incidentally, there is no particular limitation for the fluorescent whitening agent used for the fluorescent whitening dyeing treatment but that for another component of the blended product to be subjected to a fluorescent whitening dyeing may be appropriately selected and used. In addition, with regard to the condition for the treatment, common condition may be adopted although the temperature is preferably 130° C. or lower.

It is also possible that such a fluorescent whitening dyeing treatment is carried out together with the reduction by adding a fluorescent whitening agent to an aqueous solution of a reducing agent such as sodium hydrosulfite or thiourea dioxide. In that case, with regard to a fluorescent whitening agent, that which is to be used to another component for a blending product to be subjected to a fluorescent whitening dyeing may be appropriately selected and used so far as the fluorescent whitening effect is not deteriorated by sodium hydrosulfite or thiourea dioxide used as a reducing agent and by sulfuric acid or nitric acid used for an acid treatment. In addition, with regard to the treating condition, commonly used fluorescent whitening dyeing treatment conditions may be adopted within a range of the above-mentioned condition for the reducing treatment. For example, in the case where an acrylic fiber is subjected to a fluorescent whitening dyeing in a fibrous structure containing the acrylic fiber, an appropriate amount of fluorescent whitening agent for an acrylic fiber is added to an aqueous solution of a reducing agent, a treatment is conducted at 60 to 120° C. or, preferably, 80 to 100° C. for 10 to 120 minutes or, preferably, 20 to 60 minutes within a range of the above-mentioned reducing treatment condition and then an acid treatment is carried out whereupon a fibrous structure having an improved whiteness characteristic is prepared. In the case where a polyester fiber is subjected to a fluorescent whitening dyeing, since a fluorescent whitening agent for polyester is a dispersed dye type, the treating temperature is made 80 to 130° C. whereupon a fibrous structure having an improved whiteness characteristic is prepared.

Incidentally, as mentioned above, in the highly white and highly moisture absorptive and desorptive fibrous structure of the present invention, there is no limitation for the amount of the moisture absorptive and desorptive fiber. However, in a sense that characteristic of the fiber is clearly expressed as the fibrous structure, it is preferred to be contained in 5% by weight or more, more preferably in 10% by weight or more or, most preferably, in 15% by weight or more. On the other hand, it goes without saying that the fiber other than the moisture absorptive and desorptive fiber occupies the remainder and that is not always one kind of material but two or more materials may be of course blended and used. When cotton or wool is selected as such a material, its blending rate is recommended to be 30% by weight or more.

Now, there will be mentioned details of adjustment of a moisture absorptive and desorptive fiber of an acrylic acid type started from an acrylic fiber as a moisture absorptive and desorptive fiber which is particularly recommended by the present invention. Such an acrylic fiber is a fiber formed from an acrylonitrile (hereinafter, referred to as AN) type polymer containing not less than 40% by weight or, preferably, not less than 50% by weight of AN. That may be in any of forms of short fiber, tow, yarn, etc. and, further, an intermediate product during the manufacture, waste fiber, etc. may be used as well. Although there is no particular limitation for its fineness, 0.1 to 10 dtex is preferred. The AN type polymer may be any of a homopolymer of AN and a copolymer of AN with other monomer and examples of the monomer which is copolymerized with AN are a (meth) acrylate such as methyl (meth)acrylate, ethyl (meth)acrylate, butyl (meth)acrylate, dimethylaminoethyl (meth) acrylate and diethylaminoethyl (meth) acrylate, a monomer containing a sulfonic acid group such as methallylsulfonic acid, p-styrenesulfonic acid and a salt thereof, styrene, vinylacetate and (meth)acrylic acid.

In the acrylic fiber, a cross-link introducing treatment is carried out by a hydrazine compound and, in a sense that the product will be no longer dissolved in a solvent for an acrylic fiber, cross-link is formed whereupon, at the same time, an increase in nitrogen content is resulted but there is no particular limitation for the means for the introduction of cross-link. A means by which an increase in the nitrogen content is able to be adjusted to 1.0 to 10% by weight is preferred. Even when an increase in the nitrogen content is 0.1 to 1.0% by weight, any means is able to be adopted so far as it is a means by which a moisture absorptive and desorptive fiber being adoptable in the present invention is prepared. Incidentally, with regard to a means by which an increase in the nitrogen content is able to be adjusted to 1.0 to 10% by weight, a means in which a treatment is conducted in an aqueous solution of 5 to 60% by weight of a hydrazine compound at the temperature of 50 to 120° C. within 5 hours is preferred in an industrial viewpoint. In order to make an increase in the nitrogen content low, the conditions as such are to be made mild in accordance with the teaching of reaction technology. Here, an increase in the nitrogen content means a difference between the nitrogen content of the starting acrylic fiber and the nitrogen content in an acrylic fiber into which cross link is introduced by a hydrazine compound.

There is no particular limitation for the hydrazine compound used here and its examples are hydrazine hydrate, hydrazine sulfate, hydrazine hydrochloride, hydrazine hydrobromide, hydrazine carbonate, etc. as well as compounds having a plurality of amino groups such as ethylenediamine, guanidine sulfate, guanidine hydrochloride, guanidine phosphate and melamine.

A fiber which is subjected to a step of introduction of cross-link by a hydrazine compound as such may be subjected to an acid treatment. The treatment contributes in improvement of color stability of the fiber. With regard to the acid used here, examples thereof are aqueous solution of mineral acid such as nitric acid, sulfuric acid and hydrochloric acid, organic acid, etc. although there is no particular limitation about that. Before the treatment, a hydrazine compound remained in the cross-linking treatment is to be well removed. There is no particular limitation for the condition of the acid treatment and an example is that a fiber to be treated is dipped in an aqueous solution of acid concentration of 5 to 20% by weight or, preferably, 7 to 15% by weight at the temperature of 50 to 120° C. for 2 to 10 hours.

A fiber which was subjected to a step of introduction of crosslink by a hydrazine compound or further subjected to an acid treatment is then hydrolyzed by an aqueous solution of an alkaline metal salt. As a result of this treatment, hydrolysis of CN group which does not participate in the cross-link introducing treatment for an acrylic fiber by a hydrazine compound but remains there and, in case an acid treatment is conducted after the cross-linking treatment, hydrolysis of CN group remained there and $CONH_2$ group which is partially hydrolyzed by an acid treatment proceeds. Those groups form a carboxyl group by hydrolysis but, since the compound used is an alkaline metal salt, there is at last produced a carboxyl group of a metal salt type. With regard to the alkaline metal salt used here, alkaline metal hydroxide, alkaline earth metal hydroxide, alkaline metal carbonate, etc. are exemplified. Although there is no particular limitation for the concentration of the alkaline metal salt used, a means where a treatment is conducted at the temperature of 50 to 120° C. for 2 to 10 hours in an aqueous solution of 0.5 to 10% by weight, more preferably 1 to 10% by weight or, most preferably, 1 to 5% by weight is preferred in view of industry and physical property of the fiber. Incidentally, the hydrolyzing treatment mentioned here may be carried out using an inorganic acid or, in some case, using an organic acid in place of an aqueous solution of alkaline metal salt. Since a carboxyl group (acid type) is formed in that case, the group is further neutralized by means of treatment with an alkaline metal salt to give a carboxyl group of a metal salt type. It is also an effective means for whitening the moisture absorptive and desorptive fiber of an acrylic acid type that the above-mentioned hydrolyzing treatment is carried out in an oxygen-free atmosphere.

Here, with regard to the type of metal salt or the salt type of carboxyl group, its examples are alkaline metal such as Li, Na and K and alkaline earth metal such as Mg, Ca, Ba and A1. Degree of proceeding the hydrolysis or, in other words, the production amount of the carboxyl group of a metal salt type is to be suppressed to an extent of 0.5 to 10 meq/g and that can be easily carried out by a combination of concentration of the compound, temperature and treating time in the above-mentioned treatment. Incidentally, in the fiber which is prepared as a result of such a hydrolyzing treatment, CN group may or may not remain. If CN group remains, there is a possibility that additional functions utilizing its reactivity are able to be given.

As a result of such a treatment, a moisture absorptive and desorptive fiber of an acrylic acid type is prepared and, in order to further whiten the moisture absorptive and desorptive fiber of an acrylic acid type, a reducing treatment maybe carried out thereafter. With regard to an agent for the reducing treatment, an agent comprising one or more member(s) selected from a group consisting of hydrosulfite salt, thiosulfate, sulfite, nitrite, thiourea dioxide, ascorbate and a hydrazine compound may be advantageously used. There is no particular limitation for the condition of the reducing treatment and an example is that the fiber to be treated is dipped in an aqueous solution of 0.5 to 5% by weight of agent(s) at the temperature of 50° C. to 120° C. for 30 minutes to 5 hours. Incidentally, the reducing treatment may be carried out together with the above hydrolysis or may be carried out after the hydrolysis.

After the above-mentioned hydrolyzing treatment or reducing treatment, an acid treatment may be carried out so that the hue is made more stable. With regard to an acid used here, anaqueous solution of mineral acid such as nitric acid, sulfuric acid or hydrochloric acid, an organic acid, etc. may be exemplified although there is no particular limitation therefor. With regard to the condition for the acid treatment, an example is that the fiber to be treated is dipped in an aqueous solution having an acid concentration of 5 to 20% by weight or, preferably, 7 to 15% by weight at the temperature of 50 to 120° C. for 2 to 10 hours.

Since the fiber subjected to such an acid treatment has a carboxyl group (acid type), the group is converted to a carboxyl group of a metal salt type as same as in the above-mentioned case. With regard to a method for converting to a carboxyl group of a metal salt type, a method where an H type of carboxyl group is neutralized using an alkaline metal salt may be adopted. It is preferred that a molar ratio of H type to metal salt type is adjusted to from 90/10 to 0/100. In introducing a divalent metal salt into fiber, there may be adopted a treatment for adjustment of salt type in which the carboxyl group is firstly made into a univalent metal salt and then treated with a desired divalent metal salt. In a specific embodiment of the treatment for adjustment of salt type, there is a method where an aqueous solution of 0.2 to 30% by weight of metal salt is prepared in a treating vessel and the fiber to be treated is dipped therein at 20° C. to 80° C. for about 1 to 5 hour(s) or a method where the above aqueous solution is sprayed. In order to adjust to the above-mentioned ratio, a treatment for adjusting the salt type in the co-presence of a buffer is preferred. With regard to a buffer, that where a pH buffering range is 5.0 to 9.2 is preferred. The type of the metal salt of carboxyl group of a metal salt type is not limited to one but two or more kinds may be present in a blended state. Incidentally, it goes without saying that an art of adjusting the molar ratio of H type to metal salt type for the carboxyl group mentioned here is applicable to a neutralizing treatment after the above hydrolyzing treatment as well.

The above-mentioned highly white and highly moisture absorptive and desorptive fibrous structure of the present invention has a characteristic in the degree of whiteness and in the stability of the degree of whiteness of the structure. To be more specific, it has very good degree of whiteness and also stability of degree of whiteness to such an extent that, with regard to the degree of whiteness in accordance with the indication method described in JIS-Z-8729, L* is 90 or more, a* is within a range of ±2 and b* is within a range of ±10 while, with regard to the stability of the degree of whiteness, durability to washing is not lower than class 3-4. In addition, a method for the manufacture of the highly white and highly moisture absorptive and desorptive fibrous structure of the present invention has a big characteristic that a fibrous structure where a moisture absorptive and desorptive synthetic fiber having saturated index of moisture absorption of not less than 10% by weight at 20° C. and 65% RH is blended is subjected to a reducing treatment and then subjected to an acid treatment. As a result of the joint use of both treatments, there is provided a fibrous structure having an excellent stability of degree of whiteness and showing no redness which is most unfavorable in the use as clothing.

The highly white and highly moisture absorptive and desorptive fibrous structure according to the present invention is preferably applicable to all kinds of clothing such as underwear, undershirt, lingerie, pajama, clothing for babies, girdle, brassier, gloves, socks, tights, leotard and trunks, use as inner and outer clothing such as sweater, sweat suit, polo shirt, suit, sports wear and muffler, bedding such as pillow, cushion, ticking, sheets, blanket and pad, handkerchief, towel, curtain, carpet, mattress, supporter, core material, insole for shoes, slipper, material for house such as wallpaper, use in a medical field, etc. in which degree of whiteness is demanded.

Although the reason why the method for manufacturing the highly white and highly moisture absorptive and desorptive fibrous structure of the present invention gives high degree of whiteness and improves the stability of degree of whiteness has not been fully clarified yet, that is mostly presumed to be as follows. Thus, although a moisture absorptive and desorptive fiber which is one of the component materials of the fibrous structure is mostly cross-linked whereby unlimited water absorption and sticky feeling resulted thereby can be suppressed, it is still unavoidable that more or less coloring or coloration is resulted by heterologous bond contained in its cross-linking structure. In the present invention however, it is likely that such coloring or coloration bond decreases by a reducing treatment and is stabilized by further treatment with a strong acid such as nitric acid or sulfuric acid. Particularly, a cross-linked structure by a hydrazine compound is apt to be colored by introduction of a bond containing oxygen whereby a color stability is poor but, in the present invention, production of such a bond is suppressed whereby it is presumed that coloration is suppressed and coloration hardly takes place even by a treatment such as a repeated washing.

EXAMPLES

As hereunder, the present invention will be specifically illustrated. The terms "part(s)" and "%" in the Examples are those by weight unless otherwise mentioned. Incidentally, degree of whiteness and other physical data were determined by the following methods.

(1) Degree of Whiteness

Measured by a colorimeter CR 300 manufactured by Minolta and expressed by "Colour specification—CIE LAB and CIE LUV colour spaced" according to JIS-Z-8729.

(2) Durability Against Washing (Class)

A sample was repeatedly washed for ten times by a method described in JIS-L0217-103 ("Attack" manufactured by Kao is used as a detergent) and the degree of color change from the color of the sample before washing was evaluated by means of a gray scale for dirtiness according to JIS-L0805.

(3) Saturated Index of Moisture Absorption (%)

A moisture absorptive and desorptive fiber sample (about 5.0 g) was dried in a hot-air drier at 105° C. for 16 hours and the weight was measured (W1) (g). Then the sample was placed for 24 hours in a thermo-hygrostat kept at the temperature of 20° C. and 65% RH. Weight of the sample subjected to a saturated absorption was measured (W2) (g). From the result of the above measurements, calculation was conducted by the following formula.

$$(\text{Saturated index of moisture absorption } (\%))=\{(W2-W1)/W1\}\times 100$$

(4) Air Permeability

Measured in accordance with JIS-L-1096 [8.27.1 Method A (Fraziel method)]

(5) Saturated Index of Water Absorption

A moisture absorptive and desorptive fiber sample (about 5.0 g) was dried at 105° C. for 16 hours using a hot-air drier and its weight was measured (W3) (g). Then the sample was dipped in pure water so that water was absorbed therewith and dehydrated using a table centrifugal separator (type M 1410 manufactured by Kubota) at 1200 rpm for 5 minutes and weight of sample fiber after absorption of water was measured (W4) (g). Calculation was done by the following formula from the above measured result.

$$(\text{Saturated index of water absorption } (\%))=\{(W4-W3)/W3\}\times 100$$

Example A1 and Comparative Examples A1 and A2

"MOIS CARE®" (trademark) (saturated index of moisture absorption: 40.7%; saturated index of water absorption: 120%) is a moisture absorptive and desorptive fiber of an acrylic acid type which is manufactured by Toyobo. The spun yarn of 1/64 Nm is produced by blend with 30% by weight of "MOIS CARE®" and 70% by weight of Toyobo polyester fiber "2T38" in ordinary spinning system. The spun yarn sample was subjected to a reducing treatment for 50 minutes in an aqueous solution of 5 g/liter of sodium hydrosulfite in a bath ratio of 1/30 and at 80° C. The sample was further washed with water and subjected to an acid treatment for 30 minutes in an aqueous solution of 1% by weight of nitric acid in a bath ratio of 1/30 and at 50° C. This was washed with water and subjected to a neutralizing treatment in an aqueous solution of 5 g/liter of sodium acetate to which 3% by weight of NaOH to the spun yarn sample was added for 30 minutes in a bath ratio of 1/30 and at 60° C. followed by washing with water and drying to give a spun yarn. After that, the rib stitch fabric sample (Example Al) which are about 200 g/m$^2$ are knitted by the spun yarn with two plies feed in 16 gauge flat knitting machine. Degree of whiteness and stability of the degree of whiteness of the resulting knitted goods sample were tested and shown in Table 1. Comparative Example A1 and Comparative Example A2 are knitted goods samples prepared by the same manner as in Example A1 except that the above-mentioned acid treatment and the above-mentioned reducing and acid treatments were omitted, respectively and characteristics of the samples are shown in Table 1 together.

Example A2 and Comparative Examples A3 and A4

"eks®"(trademark) (saturated index of moisture absorption: 26.0%; saturated index of water absorption: 70%) is a moisture absorptive and desorptive fiber of an acrylic acid type which is manufactured by Toyobo. The spun yarn of cotton count 30/1 Ne is produced by blend with 30% by weight of "eks®", 10% by weight of acrylic fiber of Toyobo "K815-0.9T38" and 60% by weight of cotton in ordinary spinning system.

Hydrogen peroxide (30% by weight) was diluted with water to an extent of 10 ml hydrogen peroxide per one liter of water and adjusted to pH11 with NaOH. Actinol R100 which is a scouring agent manufactured by Matsumoto Yushi Seiyaku was added in an amount of 0.5 ml/liter and the above spun yarn sample was subjected to a bleaching treatment for 60 minutes at 80° C. in a bath ratio of 1/30. The sample was washed with water and subjected to a reducing treatment for 50 minutes in an aqueous solution of 5 g/liter of thiourea dioxide at 80° C. in a bath ratio of 1/30. The sample was further washed with water and subjected to an acid treatment in an aqueous solution of 1% by weight of nitric acid for 30 minutes at 50° C. in a bath ratio of 1/30. This was washed with water, subjected to a neutralizing treatment in an aqueous solution to which 3% by weight (to the spun yarn sample) of $Na_2CO_3$ was added for 30 minutes at 60° C. in a bath ratio of 1/30, washed with water and dried to give a spun yarn of Example A2. After that, the plain weave fabric samples which are about 200 g/m$^2$ are made by the spun yarn.

Degree of whiteness and stability of the degree of whiteness of the resulting plain weave fabric sample were tested and shown in Table 1. Comparative Example A3 and Comparative Example A4 were plain weave fabric samples prepared by the same manner as in Example A2 except that the above-mentioned acid treatment was not conducted (Comparative Example A3) and that an aqueous solution of 1% by weight of acetic acid was used as an acid in the acid treatment (Comparative Example A4) and characteristics of the samples are shown in Table 1 together.

Example A3 and Comparative Example A5

"eks®" (trademark) (saturated index of moisture absorption: 26.0%; saturated index of water absorption: 70%) is a moisture absorptive and desorptive fiber of an acrylic acid type which is manufactured by Toyobo. Wool blended spun yarn of 2/32 Nm is produced by blend with 30% by weight of "eks®" and 70% by weigh of wool (grade 60') in ordinary worsted spinning system. The spun yarn sample was subjected to a reducing treatment, an acid treatment and a neutralizing treatment under the same conditions as in Example A1 to prepare a spun yarn. Then, plain stitch fabric samples which are about 200 g/m$^2$ as sample A3 are knitted by the spun yarn with one-ply feed in 14 gauge flat knitting machine. Characteristics of the knitted goods sample is also given in Table 1 together. Incidentally, Comparative Example A5 is a knitted goods sample which was treated as same as in Example A3 except that no acid treatment was conducted and its characteristics are also given in Table 1 together.

Example A4 and Comparative Example A6

An acrylic polymer (limiting viscosity [η] in dimethylformamide at 30° C.: 1.2) (10 parts) comprising 96% by weight of acrylonitrile and 4% by weight of methyl acrylate was dissolved in 90 part of a 48% aqueous solution of sodium rhodamine, the resulting original spinning solution was subjected to spinning and drawing (total draw ratio: 10-fold) by a conventional method, dried and wet-heat treated under dry-bulb/wet-bulb temperature=120° C./60° C. to give a material fiber having a single fiber fineness of 1.7 dtex. The material fiber was subjected to a treatment for introduction of crosslink in a 20% by weight aqueous solution of hydrazine hydrate at 98° C. for 5 hours. As a result of this treatment, crosslink was introduced and an increase in nitrogen content was 7.0% by weight. Incidentally, an increase in nitrogen content was calculated in such a manner that the material fiber and the fiber after introduction of crosslink were subjected to elementary analysis to determine their nitrogen contents and the difference between them was calculated and that is for the material fiber. After that, a hydrolyzing treatment was carried out in a 3% by weight aqueous solution of sodium hydroxide at 90° C. for 2 hours and washing with pure water was conducted. As a result of those treatments, 5.5 meq/g of carboxyl group of an Na type was produced in the fiber. The fiber after the hydrolysis was subjected to a reducing treatment in a 1% by weight aqueous solution of sodium hydrosulfite at 90° C. for 2 hours and washed with pure water. After that, it was subjected to an acid treatment in a 3% by weight of nitric acid solution at 90° C. for 2 hours. As a result thereof, all carboxyl groups of an Na type produced in an amount of 5.5 meq/g were converted to carboxyl groups of an H type. The fiber after the acid treatment was poured into pure water, an aqueous solution of NaOH of 48% concentration was added so as to make 70 molar % of Na neutralization degree to the carboxyl groups of an H type, then calcium nitrate corresponding to 5.5 meq/g fiber was added and a treatment for adjustment of a salt type was carried out at 60° C. for 3 hours. The fiber after the above steps was washed with water, added with oil, dehydrated and dried to give a moisture absorptive and desorptive fiber A of an acrylic acid type. The saturated index of moisture absorption of the resulting fiber A was 27.6% and the saturated index of water absorption thereof was 75%.

The same operation as in Example A2 was carried out except that the fiber A was used in place of "eks®" whereupon a plain weave fabric sample of Example A4 was prepared. Characteristics of the plain weave fabric sample are also shown in Table 1 together. Incidentally, Comparative Example A6 is a plain weave fabric sample which was treated as same as in Example A4 except that an acid treatment was omitted.

TABLE 1

| | MAD | Other | Agent | Agent | Acid Treatment | | | Degree of Whiteness | | | DW |
|---|---|---|---|---|---|---|---|---|---|---|---|
| | Synthetic Fiber | Fiber | for BT | for RT | Agent | Concn | AP | L* | a* | b* | (cl) |
| Ex A1 | MOIS | Polyester | none | Na hydrosulfite | $HNO_3$ | 1 wt % | 200.3 | 97.0 | 0.2 | 2.4 | 4 |
| CE A1 | CARE ® | | | | none | | 201.0 | 92.0 | 0.5 | 4.2 | 2-3 |
| CE A2 | | | | none | none | | 200.5 | 86.0 | 6.8 | 12.5 | 3-4 |
| Ex A2 | eks ® | Cotton | $H_2O_2$ | thiourea | $HNO_3$ | 1 wt % | 40.6 | 91.8 | 1.2 | 6.3 | 3-4 |
| CE A3 | | Acrylic | | dioxide | none | | 40.8 | 88.7 | 2.7 | 9.2 | 3 |
| CE A4 | | | | | AcOH | 1 wt % | 40.6 | 89.2 | 3.0 | 8.2 | 2 |
| Ex A3 | eks ® | Wool | none | thiourea | $HNO_3$ | 1 wt % | 320.5 | 93.6 | 0.6 | 5.2 | 4 |
| CE A5 | | | | dioxide | none | | 321.0 | 94.0 | 0.5 | 5.6 | 3 |
| Ex A4 | Fiber A | Cotton | $H_2O_2$ | thiourea | $HNO_3$ | 1 wt % | 40.6 | 94.3 | −0.3 | 2.2 | 4-5 |
| CE A6 | | Acrylic | | dioxide | none | | 41.0 | 93.5 | 1.5 | 4.1 | 2 |

CE: Comparative Example
MAD: Moisture absorptive and desorptive
BT: Bleaching treatment
RT: Reducing treatment
AP: Air Permeability ($cm^3/cm^2$/second)
AcOH: acetic acid
DW: Durability to washing (cl: class)

As will be apparent from Table 1, the fibrous structures of Examples A1 to A4 showed excellent degree of whiteness and durability to washing. On the contrary, in Comparative Examples A1, A3, A5 and A6 where no acid treatment was carried out and Comparative Example A4 where an acid treatment was conducted using acetic acid, duration to washing was poor and, among them, Comparative Examples A3 and A4 were poor in terms of degree of whiteness as well. Comparative Example A2 where neither reducing treatment nor acid treatment was carried out showed poor degree of whiteness.

Example B1 and Comparative Examples B1 to B4

"eks®" (trademark) (saturated index of moisture absorption: 26.0%; saturated index of water absorption: 70%) is a moisture absorptive and desorptive fiber of an acrylic acid type which is manufactured by Toyobo. The spun yarn of cotton count 30/1 Ne is produced by blend with 30% by weight of "eks®" 10% by weight of acrylic fiber of Toyobo "K815-0.9T38" and 60% by weight of cotton in ordinary spinning system. The rib stitch fabric sample are knitted by the spun yarn with two plies feed in 16 gauge flat knitting machine.

Hydrogen peroxide (30% by weight) was diluted with water to an extent of 10 ml hydrogen peroxide per one liter of water and adjusted to pH11 with NaOH. Actinol R100 which is a scouring agent manufactured by Matsumoto Yushi Seiyaku was added in an amount of 0.5 ml/liter and the above knitted goods sample was subjected to a bleaching treatment for 60 minutes at 80° C. in a bath ratio of 1/30. The sample was washed with water and subjected to a reducing treatment for 50 minutes in an aqueous solution of 5 g/liter of thiourea dioxide at 80° C. in a bath ratio of 1/30. The sample was further washed with water and subjected to an acid treatment in an aqueous solution of 1% by weight of nitric acid for 30 minutes at 50° C. in a bath ratio of 1/30. The sample was washed with water and subjected to a neutralizing treatment in an aqueous solution of 5 g/liter of sodium acetate to which 3% by weight of NaOH were added to the knitted goods sample at 60° C. for 30 minutes in a bath ratio of 1/30, washed with water and dried to give a whitened product (Example B1) of a knitted goods where a moisture absorptive and desorptive fiber of an acrylic acid type was blended. Degree of whiteness and the stability of degree of whiteness of the resulting whitened knitted goods sample were checked and shown in Table 2. Incidentally, Comparative Examples B1 to B4 are knitted goods samples prepared by the same manner as in Example B1 except that the above-mentioned acid treatment was not carried out (Comparative Example B1) and that an aqueous solution of 1% acetic acid, formic acid or oxalic acid was used as an acid for the acid treatment (Comparative Example B2, B3 or B4, respectively) and characteristics of the samples are given in Table 2 together.

Example B2

The same operation as in Example B1 was carried out except that a 1% by weight aqueous solution of sulfuric acid was used instead of nitric acid to give a whitened product of knitted goods of Example B2 where a moisture absorptive and desorptive fiber of an acrylic acid type was blended. Characteristics of the whitened knitted goods sample are also given in Table 2 together.

Examples B3 and B4 and Referential Example

The same operation as in Example B1 was carried out except that a knitted goods sample was subjected to a bleaching treatment at 80° C. for 60 minutes in a bath ratio of 1/30 in an aqueous solution containing 2 g/liter of sodium chlorite, 3 g/liter of sodium nitrate and 3 ml/liter of Actin KL manufactured by Matsumoto Yushi Seiyaku and subjected to an acid treatment with an aqueous solution of 5 and 3% by weight of nitric acid, respectively to give whitened products of Examples B3 and B4 of knitted goods where a moisture absorptive and desorptive fiber of an acrylic acid type was blended. Characteristics of those whitened knitted goods samples are also shown in Table2 together. Incidentally, Referential Example is a knitted goods sample which was treated in the same manner as in Examples B3 and B4 except that an acid treatment was carried out with a 15% by weight aqueous solution of nitric acid.

Example B5 and Comparative Example B5

The same operation as in Example B1 was carried out except that 5 g/liter of sodium hydrosulfite was used as a reducing treatment to give a whitened product of knitted goods of Example B5 where a moisture absorptive and desorptive fiber of an acrylic acid type was blended. Characteristics of this whitened knitted goods sample are also shown in Table 2 together. Incidentally, Comparative Example B5 is a knitted goods sample which was treated in the same manner as in Example B5 except that an acid treatment with nitric acid was not carried out.

Example B6

A knitted goods which was subjected to a bleaching treatment, a reducing treatment and an acid treatment by the same manner as in Example B1 was washed with water and then subjected to a neutralizing treatment at 25° C. for 15 minutes in a bath ratio of 1/30 in an aqueous solution to which 3% by weight of sodium carbonate to knitted goods was added. After washing with water, the above was subjected to a fluorescent whitening and dyeing treatment at 50° C. for 30 minutes in a bath ratio of 1/20 in an aqueous solution containing 2% by weight (to the cotton) of Hakkol BYL which is a fluorescent whitening agent for cotton manufactured by Showa Kagaku Kogyo K. K. This was dehydrated and dried to give a whitened product of knitted goods of Example B6 where a moisture absorptive and desorptive fiber of an acrylic acid type was blended. Characteristics of the whitened knitted goods sample are also shown in Table 2 together.

Example B7 and Comparative Example B6

"eks®" (trademark) (saturated index of moisture absorption: 26.0%; saturated index of water absorption: 70%) is a moisture absorptive and desorptive fiber of an acrylic acid type which is manufactured by Toyobo. The two-ply spun yarn of 2/32 Nm is produced by blend with 30% by weight of "eks®" and 70% by weight of wool grade 60' in ordinary spinning system. After that, the rib stitch fabric samples are knitted by the spun yarn in 12 gauge flat knitting machine. The same treatments as in Example B1 were carried out except that a bleaching treatment for the knitted goods sample was omitted to give a whitened product of knitted goods of Example B7 where a moisture absorptive and desorptive fiber of an acrylic acid type was blended. Characteristics of the whitened knitted goods sample are also mentioned in Table 2 together. Incidentally, Comparative Example B6 is a knitted goods sample which was treated in the same manner as in Example B7 except that no acid treatment was carried out and its characteristics are also mentioned in Table 2 together.

Example B8

"Etiquette®" (trademark) (saturated index of moisture absorption: 20.3%; saturated index of water absorption: 60%) is a moisture absorptive and desorptive fiber of an acrylic acid type which is manufactured by Toyobo. The fabric samples of circular rib are knitted by the spun yarn of 1/64 Nm which 30% by weight of "Etiquette®" fiber and 70% by weight of acrylic fiber of Toyobo "K862-1T38" are blended in ordinary spinning system. The knitted goods sample was treated as same as in Example B7 to give a whitened product of knitted goods of Example B8 where a moisture absorptive and desorptive fiber of an acrylic acid type was blended. Characteristics of this whitened knitted goods sample are also shown in Table 2 together.

Example B9

"eks®" (trademark) (saturated index of moisture absorption: 26.0%; saturated index of water absorption: 70%) is a moisture absorptive and desorptive fiber of an acrylic acid type which is manufactured by Toyobo. The fabric samples of circular rib are knitted by the spun yarn of 1/64 Nm which 30% by weight of "eks®" fiber and was blended with 70% by weight of acrylic fiber of Toyobo "K862-1T38" are blended in ordinary spinning system. The knitted goods sample was subjected to reducing and fluorescent whitening dyeing treatments in the same bath in a bath ratio of 1/30 at 100° C. for 30 minutes in an aqueous solution containing 5 g/liter of thiourea dioxide and 2% by weight (to an acrylic fiber) of Nichilon White W which is a fluorescent whitening agent for acrylic fiber manufactured by Nissei Kasei K. K. After that, the same treatments as in Example B1 were carried out after the acid treatment to give a whitened product of knitted goods of Comparative Example B9 blended with a moisture absorptive and desorptive fiber of an acrylic acid type. Characteristics of the whitened knitted goods sample are also mentioned in Table 2 together.

Example B10

"MOIS CARE®" (trademark) (saturated index of moisture absorption: 40.7%; saturated index of water absorption: 120%) is a moisture absorptive and desorptive fiber of an acrylic acid type which is manufactured by Toyobo. The fabric samples of circular rib are knitted by the spun yarn of 1/64 Nm which 30% by weight of "MOIS CARE®" fiber and was blended with 70% by weight of a polyester fiber of Toyobo 2T38 are blended in ordinary spinning system. The knitted goods sample was treated as same as in Example B8 to give a whitened product of knitted goods of Example B10 where a moisture absorptive and desorptive fiber of an acrylic acid type was blended. Characteristics of this whitened knitted goods sample are also shown in Table 2 together.

Example B11

"MOIS CARE®" (trademark) (saturated index of moisture absorption: 40.7%; saturated index of water absorption: 120%) is a moisture absorptive and desorptive fiber of an acrylic acid type which is manufactured by Toyobo. The fabric samples of circular rib are knitted by the spun yarn of 1/64 Nm which 30% by weight of "MOIS CARE®" fiber and was blended with 70% by weight of a polyester fiber of Toyobo 2T38 are blended in ordinary spinning system. The knitted goods sample was subjected to reducing and fluorescent whitening dyeing treatments in the same bath in a bath ratio of 1/30 at 110° C. for 30 minutes in an aqueous solution containing 5 g/liter of thiourea dioxide and 1% by weight (to the polyester) of Nichilon White ETB-L (200%) which is a fluorescent whitening agent for polyester fiber manufactured by Nissei Kasei K. K. After that, the same treatments as in Example B1 were carried out after the acid treatment to give a whitened product of knitted goods of Example B11 blended with a moisture absorptive and desorptive fiber of an acrylic acid type. Characteristics of the whitened knitted goods sample are so mentioned in Table 2 together.

Example B12 and Comparative Example B7

The same operation as in Example B1 was carried out except at the fiber A prepared in Example A4 and Comparative Example A6 was used instead of "eks®" to give a whitened product of knitted goods of Example B12 blended with a moisture absorptive and desorptive fiber of an acrylic acid type. Characteristics of the whitened knitted goods sample is also mentioned in Table 2 together. Incidentally, Comparative Example B7 is a knitted goods sample which was treated as same as in Example B12 except that reduction was carried out with a 5 g/liter aqueous solution of sodium thiosulfate.

Examples B1 and B2 and an acid treatment was conducted with nitric acid of concentrations of 3 and 5% by weight, respectively showed degree of whiteness and stability of the degree of whiteness which were as good as those of Examples B1 and B2. However, in Referential Example where an acid treatment was conducted with nitric acid concentration of as high as 15% by weight, although durability to washing was good, degree of whiteness was somewhat poor resulting in generation of darkness for example. Thus it is understood that just a strong acid treatment after the reducing treatment is not almighty.

In Example B5 where the type of the reducing agent was different, b* was somewhat as high as 9.1 as compared with

TABLE 2

| | | Blended | Bleaching | Reducing | Acid Treatment | | | Degree of Whiteness | | | DW |
|---|---|---|---|---|---|---|---|---|---|---|---|
| | MADF | one | agent | agent | Agent | Concn | FWD | L* | a* | b* | (cl) |
| Ex B1 | eks ® | Cotton | $H_2O_2$ | Thiourea dioxide | $HNO_3$ | 1 wt % | none | 95.0 | 0.5 | 5.9 | 4 |
| Ex B2 | | | | | $H_2SO_4$ | 1 wt % | none | 96.5 | −0.6 | 4.8 | 4 |
| CE B1 | | | | | none | | none | 89.0 | 4.8 | 8.4 | 3 |
| CE B2 | | | | | AcOH | 1 wt % | none | 91.9 | 3.0 | 9.9 | 2 |
| CE B3 | | | | | FoOH | 1 wt % | none | 88.1 | 4.1 | 10.1 | 2 |
| CE B4 | | | | | OxOH | 1 wt % | none | 90.0 | 1.7 | 11.2 | 2 |
| Ex B3 | eks ® | Cotton | Na chlorite | Thiourea dioxide | $HNO_3$ | 3 wt % | none | 94.5 | −0.7 | 6.3 | 3-4 |
| Ex B4 | | | | | $HNO_3$ | 5 wt % | none | 97.0 | −0.5 | 3.4 | 4 |
| RE | | | | | $HNO_3$ | 15 wt % | none | 89.3 | 5.6 | 8.9 | 4 |
| Ex B5 | eks ® | Cotton | $H_2O_2$ | Na hydrosulfite | $HNO_3$ | 1 wt % | none | 93.0 | −0.4 | 9.1 | 3-4 |
| CE B5 | | | | | none | | none | 88.3 | 3.4 | 10.7 | 2 |
| Ex B6 | eks ® | Cotton | $H_2O_2$ | Thiourea dioxide | $HNO_3$ | 1 wt % | *1 | 96.6 | 0.2 | 5.7 | 4 |
| Ex B7 | eks ® | Wool | none | Thiourea dioxide | $HNO_3$ | 1 wt % | none | 93.1 | 0.2 | 5.2 | 4 |
| CE B6 | | | | | none | | none | 94.4 | 0.3 | 7.0 | 3 |
| Ex B8 | Etq | Acrylic | none | Thiourea dioxide | $HNO_3$ | 1 wt % | none | 92.0 | 0.4 | 9.3 | 4 |
| Ex B9 | eks ® | Acrylic | none | Thiourea dioxide | $HNO_3$ | 1 wt % | *2 | 95.0 | 0.4 | 7.1 | 4 |
| Ex B10 | Msc ® | Polyester | none | Thiourea dioxide | $HNO_3$ | 1 wt % | none | 97.3 | 0.1 | 2.6 | 4 |
| Ex B11 | | | | | $HNO_3$ | 1 wt % | *2 | 98.2 | −0.1 | 2.2 | 4 |
| Ex B12 | Fiber A | Cotton | $H_2O_2$ | Na thiosulfate | $HNO_3$ | 1 wt % | none | 95 | −0.2 | 2.0 | 4-5 |
| CE B7 | | | | | $HNO_3$ | 1 wt % | none | 86.4 | 6.7 | 12.3 | 2 |

CE: Comparative Example
RE: Referential Example
MADF: Moisture absorptive and desorptive fiber of an acrylic acid type used
Etq: Etiquette ®
Msc: MOIS CARE ®
AcOH: acetic acid
FoOH: formic acid
OxOH: oxalic acid
FWD: Treatment of fluorescent whitening dyeing
*1: after an acid treatment
*2: upon reduction
DW: Durability to washing (cl: class)

Degree of whiteness of the knitted goods of Example B1 where a moisture absorptive and desorptive fiber of an acrylic acid type is blended showed 95.0 of L*, 0.5 of a* and 5.9 of b* and was a knitted goods having no redness. Durability to washing was class 4 showing an excellent stability of degree of whiteness. Example B2 where an agent for an acid treatment was different from the agent used in Example B1 showed the result which was as good as that of the knitted goods of Example B1. On the contrary, degree of whiteness of Comparative Example B1 where no acid treatment was carried out showed 89.0 of L*, 4.8 of a* and 8.4 of b* where the redness was strong. In addition, durability to washing was class 3 showing a low stability. Comparative Examples B2 to B4 which were treated with other acid than nitric acid and sulfuric acid showed a high a* and the products were with strong redness or with poor durability to washing.

Examples B3 and B4 where the type of the bleaching agent was different from the type of the agent used in Example B1 and it was yellowish while a* was −0.4 giving little redness and durability to washing was good as well whereby the product was in a practical level. On the other hand, in Comparative Example B5 where no acid treatment was carried out, L* was 88.3, a* was 3.4 and b* was 10.7 and durability to washing was also as significantly low as class 2.

In Comparative Example B6 where a knitted goods comprising a moisture absorptive and desorptive fiber of an acrylic acid type and wool was reduced with thiourea dioxide and no acid treatment was conducted, although its degree of whiteness was as good as 94.4 of L*, 0.3 of a* and 7.0 of b*, its durability to washing was class 3 which was in a level causing a problem in a using stage as the final product while, in Example B7, an acid treatment with nitric acid was carried out whereby degree of whiteness and durability to washing were improved to such a level that there was no practical problem.

Examples B8 and B10 where a knitted goods in which a moisture adsorptive and desorptive fiber of an acrylic acid type having different saturated index of moisture absorption was blended with acrylic fiber and polyester fiber, respectively was subjected to a reducing treatment and then with an acid treatment also showed good degree of whiteness and durability to washing.

In Example B12 where a moisture absorptive and desorptive fiber of an acrylic acid type having a saturated index of moisture absorption of 27.6% was used and blended with cotton and, after that, hydrogen peroxide was used as a bleaching agent, thiourea dioxide was used as a reducing agent and nitric acid was used as an acid treating agent for the resulting knitted goods, its degree of whiteness was as good as 95.0 of L*, −0.2 of a* and 2.0 of b* and durability to washing was also as good as class 4 to 5 whereby it was a good knitted goods. Comparative Example B7 was different from Example B12 in such a respect that sodium thiosulfate was used as a reducing agent and it was hardly said to be in white color because of 86.4 of L*, 6.7 of a* and 12.3 of b* and durability to washing was also poor because of class 2.

In Example B6, a neutralizing treatment was carried out after the acid treatment of Example B1 and then staining with a fluorescent dye for cotton was conducted where degree of whiteness was further improved and durability to washing was in such a level that there was no practical problem.

In addition, in Example B9 where a fluorescent dye for acrylic was applied upon reduction of the knitted goods where acrylic was blended and in Example B11 where a fluorescent dye for polyester was applied upon reduction of the knitted goods where polyester was blended, improvement in degree of whiteness by the fluorescent dye was also noted and durability to washing was in such a level that there was no practical problem.

Advantage of the Invention

The fibrous structure of the present invention has a moisture absorptive and desorptive property and it still has an excellent whiteness showing an excellent stability in whiteness where degree of whiteness hardly changes even upon repeated washings whereby it is able to be advantageously used for clothing such as underwear and sweater, curtain, bedding such as blanket, etc.

Up to now, a moisture absorptive and desorptive fiber of an acrylic acid type has a light pink color and, as a result of bleaching treatment for the fibrous structure blended with cotton, redness increases and, in the case of the fibrous structure blended with wool, durability of whiteness to washing is lost by a reducing treatment whereby there has not been available a fibrous structure where degree of whiteness is high and stable. In accordance with the present invention however, it is now possible to provide a fibrous structure where a moisture absorptive and desorptive property is maintained, degree of whiteness is high and there is no color change even upon repeated washings in the final product or, in other words, a fibrous structure having an excellent stability of degree of whiteness.

The invention claimed is:

1. A method for the manufacture of a highly white and highly moisture absorptive and desorptive fibrous structure which comprises subjecting a fibrous structure comprising a moisture absorptive and desorptive synthetic fiber having a saturated index of moisture absorption of 10% by weight or more at 20° C. and 65% RH blended with another fiber, to reduction with sodium hydrosulfite or with thiourea dioxide and then subjecting the resultant product to an acid treatment with sulfuric acid or nitric acid, wherein said moisture absorptive and desorptive synthetic fiber is a moisture absorptive and desorptive acrylic acid fiber produced by treating an acrylic fiber with a hydrazine compound to introduce crosslinkages, subjecting the fiber to hydrolysis to introduce carboxyl group, and if necessary, introducing a metal carboxylate group by neutralization, wherein said fibrous structure has been prepared by subjecting a fibrous structure which contains 5% by weight or more of said moisture absorptive and desorptive acrylic acid fiber as said moisture absorptive and desorptive synthetic fiber and 30% by weight or more of cotton to a bleaching treatment with hydrogen peroxide or sodium chlorite, and wherein saturated index of water absorption of said moisture absorptive and desorptive synthetic fiber is less than 300% by weight.

2. A method for the manufacture of a highly white and highly moisture absorptive and desorptive fibrous structure which comprises subjecting a fibrous structure comprising a moisture absorptive and desorptive synthetic fiber having a saturated index of moisture absorption of 10% by weight or more at 20° C. and 65% RH blended with another fiber, to reduction with sodium hydrosulfite or with thiourea dioxide and then subjecting the resultant product to an acid treatment with sulfuric acid or nitric acid, wherein said moisture absorptive and desorptive synthetic fiber is a moisture absorptive and desorptive acrylic acid fiber produced by treating an acrylic fiber with a hydrazine compound to introduce crosslinkages, subjecting the fiber to hydrolysis to introduce carboxyl group, and if necessary, introducing a metal carboxylate group by neutralization, wherein said fibrous structure has been prepared by subjecting a fibrous structure which contains 5% by weight or more of said moisture absorptive and desorptive acrylic acid fiber as said moisture absorptive and desorptive synthetic fiber and 30% by weight or more of cotton to a bleaching treatment with hydrogen peroxide or sodium chlorite, and wherein a fluorescent whitening dyeing treatment is carried out together with said reduction and/or after said acid treatments.

3. A method for the manufacture of a highly white and highly moisture absorptive and desorptive fibrous structure which comprises subjecting a fibrous structure comprising a moisture absorptive and desorptive synthetic fiber having a saturated index of moisture absorption of 10% by weight or more at 20° C. and 65% RH blended with another fiber, to reduction with sodium hydrosulfite or with thiourea dioxide and then subjecting the resultant product to an acid treatment with sulfuric acid or nitric acid, wherein said moisture absorptive and desorptive synthetic fiber is a moisture absorptive and desorptive acrylic acid fiber produced by treating an acrylic fiber with a hydrazine compound to introduce crosslinkages, subjecting the fiber to hydrolysis to introduce carboxyl group, and if necessary, introducing a metal carboxylate group by neutralization, wherein said fibrous structure contains 5% by weight or more of said moisture absorptive and desorptive acrylic acid fiber as said moisture absorptive and desorptive fiber and 30% by weight or more of wool, and wherein saturated index of water absorption of said moisture absorptive and desorptive synthetic fiber is less than 300% by weight.

4. A method for the manufacture of a highly white and highly moisture absorptive and desorptive fibrous structure which comprises subjecting a fibrous structure comprising a moisture absorptive and desorptive synthetic fiber having a saturated index of moisture absorption of 10% by weight or more at 20° C. and 65% RH blended with another fiber, to reduction with sodium hydrosulfite or with thiourea dioxide and then subjecting the resultant product to an acid treatment with sulfuric acid or nitric acid, wherein said moisture absorptive and desorptive synthetic fiber is a moisture absorptive and desorptive acrylic acid fiber produced by treating an acrylic fiber with a hydrazine compound to introduce crosslinkages, subjecting the fiber to hydrolysis to introduce carboxyl group, and if necessary, introducing a metal carboxylate group by neutralization, wherein said fibrous structure contains 5% by weight or more of said moisture absorptive and desorptive acrylic acid fiber as said moisture absorptive and desorptive fiber and 30% by weight or more of wool, and wherein a fluorescent whitening dyeing treatment is carried out together with said reduction and/or after said acid treatments.

5. A method for the manufacture of a highly white and highly moisture absorptive and desorptive fibrous structure, which comprises subjecting a fibrous structure comprising a moisture absorptive and desorptive synthetic fiber having a saturated index of moisture absorption of 10% by weight or more at 20° C. and 65% RH blended with another fiber, to reduction with sodium hydrosulfite or with thiourea dioxide and then subjecting the resultant product to an acid treatment with sulfuric acid or nitric acid, wherein said fibrous structure has been prepared by subjecting a fibrous structure which contains 5% by weight or more of said moisture absorptive and desorptive fiber of an acrylic acid type as said moisture absorptive and desorptive synthetic fiber and 30% by weight or more of cotton to a bleaching treatment with hydrogen peroxide or sodium chlorite.

6. A method for the manufacture of a highly white and highly moisture absorptive and desorptive fibrous structure according to claim 5, wherein the degree of whiteness of said fibrous structure in terms of indication method described in JIS Z 8729 is that L* is 90 or more, a* is within a range of ±2 and b* is within a range of ±10 and the durability of whiteness degree against washing after washing for ten times is class 3-4 or higher.

7. A method for the manufacture of a highly white and highly moisture absorptive and desorptive fibrous structure, which comprises subjecting a fibrous structure comprising a moisture absorptive and desorptive synthetic fiber having a saturated index of moisture absorption of 10% by weight or more at 20° C. and 65% RH blended with another fiber, to reduction with sodium hydrosulfite or with thiourea dioxide and then subjecting the resultant product to an acid treatment with sulfuric acid or nitric acid, wherein said fibrous structure contains 5% by weight or more of said moisture absorptive and desorptive fiber of an acrylic acid type as said moisture absorptive and desorptive fiber and 30% by weight or more of wool.

8. A method for the manufacture of a highly white and highly moisture absorptive and desorptive fibrous structure according to claim 7, wherein the degree of whiteness of said fibrous structure in terms of indication method described in JIS Z 8729 is that L* is 90 or more, a* is within a range of ±2 and b* is within a range of ±10 and the durability of whiteness degree against washing after washing for ten times is class 3-4 or higher.

9. A highly white and highly moisture absorptive and desorptive fibrous structure containing 5% by weight or more of a moisture absorptive and desorptive synthetic fiber of an acrylic acid type having a saturated index of moisture absorption of 10% by weight or more at 20° C. and 65% RH and 30% by weight or more of cotton, wherein the degree of whiteness of said fibrous structure in terms of indication method described in JIS Z 8729 is that L* is 90 or more, a* is within a range of ±2 and b* is within a range of ±10 and the durability of whiteness degree against washing after washing for ten times is class 3-4 or higher.

10. A highly white and highly moisture absorptive and desorptive fibrous structure containing 5% by weight or more of a moisture absorptive and desorptive synthetic fiber of an acrylic acid type having a saturated index of moisture absorption of 10% by weight or more at 20° C. and 65% RH and 30% by weight or more of wool, wherein the degree of whiteness of said fibrous structure in terms of indication method described in JIS Z 8729 is that L* is 90 or more, a* is within a range of ±2 and b* is within a range of ±10 and the durability of whiteness degree against washing after washing for ten times is class 3-4 or higher.

* * * * *